United States Patent [19]

Bittel

[11] Patent Number: 5,014,341

[45] Date of Patent: May 7, 1991

[54] HYBRID MASTER CONTROL DESK FOR ANALOG AND DIGITAL AUDIO SIGNALS

[75] Inventor: Bertram Bittel, Kappelstrodeck, Fed. Rep. of Germany

[73] Assignee: Werbung im Südwestfunk GmbH, Baden, Fed. Rep. of Germany

[21] Appl. No.: 439,351

[22] PCT Filed: Mar. 14, 1989

[86] PCT No.: PCT/EP89/00270

§ 371 Date: Nov. 2, 1989

§ 102(e) Date: Nov. 2, 1989

[87] PCT Pub. No.: WO89/08955

PCT Pub. Date: Sep. 21, 1989

[30] Foreign Application Priority Data

Mar. 17, 1988 [DE] Fed. Rep. of Germany ..... 3808876

[51] Int. Cl.[5] ..... H04H 1/00; H04H 5/00

[52] U.S. Cl. ..... 455/3; 381/2; 381/3; 381/119

[58] Field of Search ..... 455/3, 6, 103; 375/5; 381/2-3, 119

[56] References Cited

U.S. PATENT DOCUMENTS 4,723,285 2/1988 LeRoy et al. ..... 381/2
4,787,085 11/1988 Suto et al. ..... 381/2
4,922,536 5/1990 Hoque ..... 381/2

OTHER PUBLICATIONS

Richards et al., "An Experimental All-Digital Studio Mixing Desk", Audio Engineering Society, vol. 30, No. 3, Mar. 1982.

"The Radio and Electronic Engineer", Band 53, Nov. 7/8, Jul./Aug 1983, IERE Cloudon, 6B)-Digital Audo Mixing.

*Primary Examiner*—Reinhard J. Eisenzopf
*Assistant Examiner*—Andrew Faile
*Attorney, Agent, or Firm*—Spencer & Frank

[57] ABSTRACT

For a digital/analog master control desk for audio signals, it is proposed to sum the analog channel signals, possibly while simultaneously processing them. Forming the analog broadcast signal, this sum is added to a further channel signal $A_n$ which is formed of the analog-converted sum of the digital channel signals. A digital signal $D_n$ obtained from the digital-converted sum of the analog channel signals is added to the sum of the digital channel signals, resulting in a digital broadcast signal which has the same modulation content as the analog broadcast signal.

4 Claims, 1 Drawing Sheet

HYBRID MASTER CONTROL DESK FOR ANALOG AND DIGITAL AUDIO SIGNALS

BACKGROUND OF THE INVENTION

The invention relates to a master control desk for producing broadcast signals wherein a plurality of analog channel signals are summed and a further channel is added to the sum of the plurality of signals to produce an analog broadcast signal. Such a master control desk is described in (brochures entitled "Studer 900 Professionelle Regietechnik PI 3/82 D/E [Studer 900 Professional Control Technique PI 3/82 D/E] published by Studer International AG, Regensdorf, Switzerland.

For digital broadcast signals as they are intended, for example, for satellite radio broadcasts, it is known (as described in a brochure entitled "Neues Digitalstudio für den WDR" [Novel Digital Studio for the West German Broadcasting System] published by Siemens AG) to process a plurality of incoming digital channel signals by means of digital function units. The digital channel signals originate either directly from digital audio signal sources such as, for example, CD players or DAT recorders, or they are obtained from analog audio signal sources by analog/digital conversion. Such digital master control desks are connected with structural and financial investments which are a multiple of that for analog control desks and require audio engineers to change their operating philosophy unless they want to take the even more expensive step of translating the customary operating philosophy for analog control desks by means of suitable software. Since the development of a broadcast involves different operating philosophies in each broadcast station, such software would have to be developed specifically for each station which would drive expenditures to a level that could no longer be justified.

SUMMARY OF INVENTION

It is therefore an object of the invention to provide a master control desk which permits, without changing operator philosophy, the generation of an analog broadcast signal as well as a digital broadcast signal, and does not impair the quality of the input signals originating from digital audio signal sources due to their digital-/analog conversion and subsequent analog/digital conversion. The above objects are achieved without requiring unjustifiably high technical expenditures.

This is accomplished by a master control desk comprising an analog device and a digital device which respectively produce an analog broadcast signal and a digital broadcast signal. The analog device includes means for receiving and processing a plurality of analog channel signals to produce a sum, analog to digital means for converting the sum of the processed analog channel signals into a digital signal, and analog summing means for summing signals received through its inputs where one input receives the output of the analog processing means and the other input receives an analog signal from the digital device to produce the analog broadcast signal.

The digital device includes means for receiving and processing a plurality of digital channel signals, to produce a sum digital to analog means for converting the sum of the processed digital channel signals into the analog signal which is received by the analog summing means, and digital summing means having two inputs for summing signals received through its inputs where one input receives the output of the digital processing means and the other input receives the digital signal obtained from the conversion of the sum of the analog channel signals to produce the digital broadcast signal so that it has the same modulation content as the analog broadcast signal.

The master control desk according to the invention as, described above, employs a hybrid technology in which the input signals originating from digital audio signal sources are initially summed and a further digital signal corresponding to the sum of the processed analog input signals of the master control desk is added to this digital sum signal. The signal resulting therefrom constitutes the digital broadcast signal. Additionally, in the analog portion of the master control desk according to the invention, a further analog signal obtained from the sum of the processed digital input signals is added to the sum of the processed analog input signals. The signal resulting therefrom constitutes the analog broadcast signal. The analog broadcast signal and the digital broadcast signal have the identical modulation content. The surface of the master control desk is practically unchanged and is merely supplemented by level adjusters for the input signals coming from digital audio signal sources. As an alternative, analog level adjusters which are no longer required may be replaced by level adjusters for the digital audio signal sources. The fact that a digital broadcast signal and an analog broadcast signal are generated in parallel with one another in the master control desk according to the invention has the further advantage that interference in the digital portion does not lead to cessation of the broadcast. Each digital audio signal source, in addition to its digital signal output, also has a corresponding analog signal output which, for reserve purposes, can be connected with analog inputs of the master control desk so that the signals originating from digital signal sources, in the case of a breakdown, can be processed via the analog portion of the master control desk according to the invention and can be included in the analog broadcast signal. Since, for reasons of reserve capability, digital line transmitters have an additional input for an analog broadcast signal, transmission on the purely digital transmission path is also ensured in an emergency.

BRIEF DESCRIPTION OF THE DRAWINGS

The invention will now be described in greater detail with reference to the drawings in which.

DESCRIPTION OF THE PREFERRED EMBODIMENT

Figure 2:
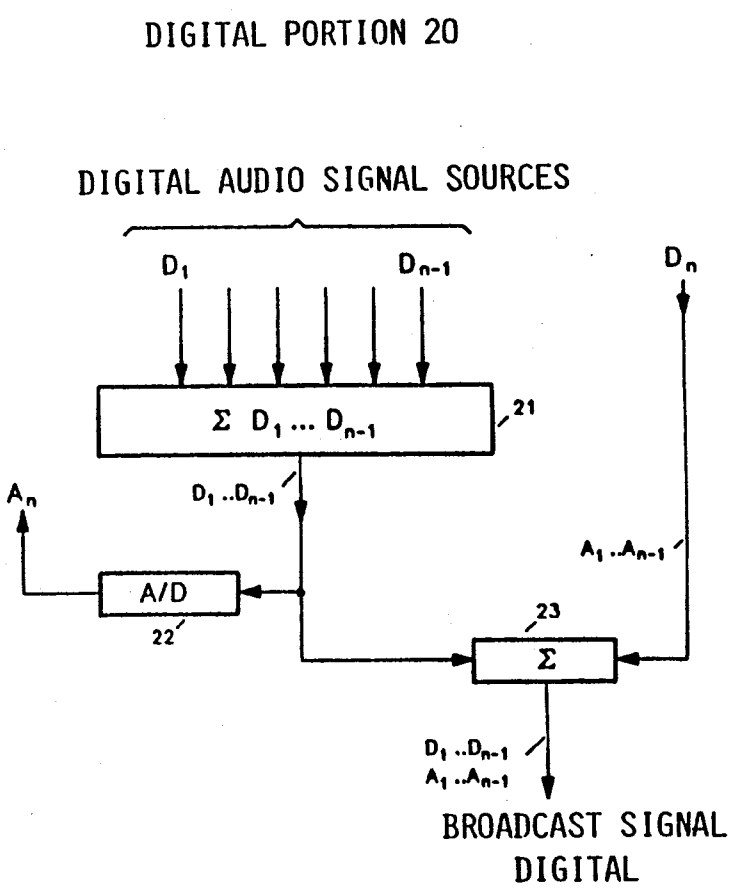
FIG. 2 is a schematic block circuit diagram of a digital device of the master control desk according to the invention.
Figure 1:
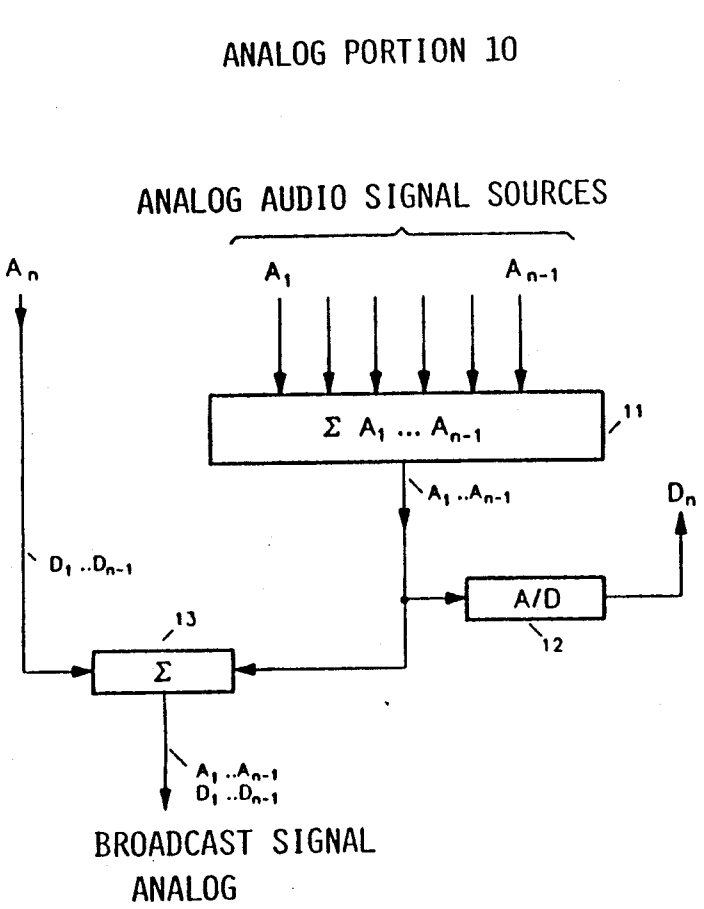
FIG. 1 depicts a block circuit diagram of an analog device for the master control desk according to the invention.

The master control desk shown in the drawings includes an analog portion 10 shown in FIG. 1 and a digital portion 20 shown in FIG. 2. For reasons of clarity, both portions 10 and 20 are separated from one another by a dashed dividing line; however, the two portions are in communication with one another as described below. Analog portion 10 includes a processing section 11 which receives a plurality of analog input signals $A_1$ to $A_{n-1}$. As customary, processing section 11 includes level adjusters, filters, switching members, monitoring devices and the like. A processed sum signal of analog input signals $A_1$ to $A_{n-1}$ is generated at the output of processing section 11. This sum signal is fed to an analog/digital converter 12 as well as to a summing member 13. Output signal $D_n$ of analog/digital converter 12 is fed to digital portion 20 from which an analog signal $A_n$ is fed to the second input of summing member 13. As will be explained in greater detail below, the output signal of summing member 13 constitutes the analog broadcast signal.

Digital portion 20 includes a processing section 21 which receives a plurality of digital input signals $D_1$ to $D_{n-1}$. These digital audio signals generally originate from digital audio signal sources such as, for example, CD players, DAT recorders or digital signal lines (e.g. from the Federal Postal Service). In a simple version, digital processing section 21 is composed only of level adjusters since the feeding in of signals from digital audio signal sources other than a level control requires no further processing, such as, for example filtering. If necessary, processing section 21 may of course also contain digital filters, switching devices and the like.

Processing section 21 further includes monitoring devices such as, for example, an audition key, a digital display of transmission level and many more. The processing of processing section 21 is, as already mentioned above, incorporated into the processing of processing section 11 so that the operating philosophy of analog master control desks to which the audio engineer is accustomed is available.

The sum signal of the processed input signals $D_1$ to $D_{n-1}$ is present at the output of processing section 21 and is fed to a digital/analog converter 22 and to a summing member 23. The output signal $D_n$ of analog/digital converter 12 of analog portion 10 is present at the second input of summing member 23, which is equivalent to the digitalized version of the sum of the processed analog signals and is added to the sum of the processed digital signals. As already mentioned, the output signal $A_n$ of digital/analog converter 22 is fed to the second input of summing member 13 of analog portion 10. This means the analog version of the sum of the processed digital signals is fed to the sum of the processed analog signals. The output signal of summing member 23 constitutes the digital broadcast signal. If one compares the broadcast signals at the outputs of summing members 13 and 23, it will be noted that both signals (a) contain the sum of the processed analog signals $A_1$ to $A_{n-1}$; and (b) the sum of the processed digital signals $D_1$ to $D_{n-1}$.

With the aid of the master control desk according to the invention it is possible, without loss of quality, to achieve a very cost-effective, fast and flexible entry into digital audio radio at the studio level. The need for acquiring a large, expensive master control desk in purely digital technology is obviated, as well as the necessity to reschool audio engineers resulting from such an acquisition.

I claim:

1. Master control desk for audio signals comprising:

an analog device including means for receiving and processing a plurality of analog channel signals to produce a sum, analog to digital means connected to the output of the analog processing means and for converting the sum of the analog channel signals into a digital signal, and analog summing means having two inputs for summing signals received through its inputs to produce an analog broadcast signal, where one input of the analog summing means receives the output of the analog processing means and the other input receives a further analog signal; and a digital device including means for receiving and processing a plurality of digital channel signals to produce a sum, digital to analog means connected to the output of the digital processing means and for converting the sum of the digital channel signals into the further analog signal which is received by the analog summing means, and digital summing means having two inputs for summing signals received through its inputs to produce a digital broadcast signal, where one input of the digital summing means receives the output of the digital processing means and the other input receives the digital signal obtained from the conversion of the sum of the analog channel signals so that the digital device produces a digital broadcast signal having the same modulation context as the analog broadcast signal.

2. The master control desk according to claim 1, wherein the analog processing means concurrently sums the plurality of analog channel signals while processing those signals.

3. The master control desk according to claim 1, wherein the digital processing means concurrently sums the plurality of digital channel signals while processing those signals.

4. The master control desk according to claim 1, wherein the analog device processing means concurrently sums the plurality of analog channel signals while processing those signals and the digital processing means concurrently sums the plurality of digital channel signals while processing those signals.

* * * * *